US008406447B2

(12) United States Patent
Kromann et al.

(10) Patent No.: US 8,406,447 B2
(45) Date of Patent: Mar. 26, 2013

(54) EARPHONE DEVICE WITH EAR CANAL PROTRUSION

(75) Inventors: Per Kromann, Nibe (DK); Tommy Le, Aalborg (DK)

(73) Assignee: GN Netcom A/S (DK)

( * ) Notice: Subject to any disclaimer, the term of this patent is extended or adjusted under 35 U.S.C. 154(b) by 15 days.

(21) Appl. No.: 12/671,843

(22) PCT Filed: Aug. 4, 2008

(86) PCT No.: PCT/DK2008/000282

§ 371 (c)(1),
(2), (4) Date: Mar. 31, 2011

(87) PCT Pub. No.: WO2009/018825

PCT Pub. Date: Feb. 12, 2009

(65) Prior Publication Data

US 2011/0261988 A1 Oct. 27, 2011

(30) Foreign Application Priority Data

Aug. 8, 2007 (DK) ..... 2007 01133

(51) Int. Cl.
*H04R 25/00* (2006.01)

(52) U.S. Cl. ..... 381/380; 381/328; 379/430

(58) Field of Classification Search ..... 381/322, 381/328, 380–381; 181/129–131; 379/430
See application file for complete search history.

(56) References Cited

U.S. PATENT DOCUMENTS

| | | | | |
|---|---|---|---|---|
| 3,935,401 | A | 1/1976 | Shore et al. | |
| 6,122,388 | A | 9/2000 | Feldman | |
| D470,123 | S | 2/2003 | Hlas et al. | |
| 6,810,987 | B1 * | 11/2004 | DeKalb | 181/129 |
| 7,031,485 | B2 * | 4/2006 | Webber et al. | 381/380 |
| 7,412,068 | B2 * | 8/2008 | Bayer | 381/328 |
| 7,899,194 | B2 * | 3/2011 | Boesen | 381/380 |
| 7,925,038 | B2 * | 4/2011 | Taenzer et al. | 381/381 |
| 7,965,855 | B1 * | 6/2011 | Ham | 381/380 |
| 8,139,806 | B2 * | 3/2012 | Hosaka et al. | 381/380 |
| 2006/0147078 | A1 | 7/2006 | Neu et al. | |
| 2008/0152182 | A1 | 6/2008 | Bevirt et al. | |

FOREIGN PATENT DOCUMENTS

| | | |
|---|---|---|
| EP | 0 825 796 | 8/1997 |
| EP | 1355508 | 10/2003 |
| EP | 1569499 | 8/2005 |
| WO | WO 98/31193 | 7/1998 |
| WO | WO 01/50813 | 7/2001 |
| WO | WO 2006/104981 | 10/2006 |

OTHER PUBLICATIONS

Plantronics Discovery 650e Userguide, 2006.
International Search Report for PCT/DK2008/000282.

* cited by examiner

*Primary Examiner* — Suhan Ni
(74) *Attorney, Agent, or Firm* — Altera Law Group, LLC

(57) ABSTRACT

An earphone device (1) comprising a main body (14) to be inserted in to the outer ear (28) of a user. The main body (14) has a first side (5) that faces the user's head when inserted, a cavity (13) and a sound opening (2) connecting the first side (5) with the cavity (13). The main body (14) further comprises an ear canal protrusion (3) to be inserted into the ear canal (7). The cross section of the ear canal protrusion (3) is smaller than the cross section of the ear canal (7) and the ear canal protrusion (3) is having a first side (8) adapted to lie against the ear canal wall (10) and a second side (9) lying opposite the first side (8) and beside the sound opening (2).

14 Claims, 3 Drawing Sheets

EARPHONE DEVICE WITH EAR CANAL PROTRUSION

TECHNICAL FIELD

The invention relates to an earphone device according to the preamble of claim 1.

BACKGROUND ART

Earphone devices like the one according to the preamble of claim 1 are typically used in connection with telecommunication or audio listening. The main requirements to such a device are to ensure a good acoustic coupling with the ear, a secure attachment to the ear and a comfortable wearing.

The prior art discloses several attempts to provide earphone devices seeking to fulfill one or more of these requirements.

EP 1 364 553 B1 discloses an earphone device with a mouthpiece adapted for being inserted into the mouthing of the ear canal and a leaf spring with a varying spring rigidity to abut the conchal wall.

U.S. Pat. No. 6,122,388 discloses an earphone device with a helix protrusion and an ear canal protrusion. The earphone device is secured within the outer ear of the user by the helix protrusion and wall regions that engage the conchal wall and the area of the tragus. The ear canal protrusion does not engage the ear canal wall. A sound channel extends through the ear canal protrusion.

WO 2006/104981 discloses an earphone device according to the preamble of claim 1, wherein a speaker is arranged in the tip of the ear canal protrusion. A disadvantage with this device is that it requires a very small speaker that can be fitted into the tip of the ear canal protrusion.

WO 96/23443 discloses an earphone device according to the preamble of claim 1. A sound bore is provided in the ear canal protrusion. This bore provides means for the sound to travel from the speaker part of the audio communications device to the ear canal of the user. The sound bore is according to the description preferably 0.10 inches (2.54 mm) in diameter. In this way, the sound is lead directly into the ear canal, while the protrusion is preventing surrounding noise from entering the ear canal. A problem with this solution is that the relatively long and narrow sound bore dampens the higher frequencies and thus acts as a high frequency filter. This can make speak harder to understand and reduce the pleasure of music listening.

DISCLOSURE OF INVENTION

The object of the invention is to provide an earphone device that ensures a good acoustic coupling, is comfortable to wear and is firmly held in the ear. The earphone device according to the invention is characterised in that the cross section of the ear canal protrusion is smaller than the cross section of the ear canal and that the ear canal protrusion is having a first side adapted to lie against the ear canal wall and an second side lying opposite the first side and beside the sound opening. In this way, the earphone device utilizes the ear canal to support itself in the outer ear and ensures that the sound opening is located close to the ear canal and thus a good acoustic coupling. Dampening of the high frequencies can be minimized as a relatively large opening can be provided beside the ear canal protrusion. In addition, other disadvantages, such as occlusion effects or other discomfort due to sealing off the ear canal, are avoided with the solution according to the invention.

According to an embodiment, the second side of the ear canal protrusion is bordering the periphery of the sound opening. Thereby, it is ensured that sound is directed to the ear canal.

Preferably, the ear canal protrusion extends along a part of the sound openings periphery.

According to an embodiment, the first side of the ear canal protrusion is convex seen in cross-section perpendicular to axis of the sound opening, when the earphone is secured in the ear of a user. Hereby, a more comfortable abutment of the ear canal protrusion against the ear canal wall is obtained.

Furthermore, the second side of the ear canal protrusion may be concave seen in cross-section perpendicular to axis of the sound opening, when the earphone is secured in the ear of a user. Thus, a gutter shaped or through shaped ear canal protrusion is obtained which ensures a proper alignment of the sound opening to the ear and at the same time a relatively firm ear canal protrusion.

According to a preferred embodiment, the earphone device comprises a conchal wall stabilizer extending from the main body and adapted to engage the conchal wall of the ear. Preferably, the conchal wall stabilizer extends from the main body in a direction essentially opposite the first side of the ear canal protrusion, such that the earphone device can be firmly fixed between the ear canal wall and the conchal wall. In this embodiment, the sound opening is located between the ear canal protrusion and the conchal wall stabilizer.

The conchal wall stabilizer may be loop shaped. A loop shaped conchal wall stabilizer is easy to provide with a proper stiffness and at the same time sufficient durability.

Preferably, the main body, the ear canal protrusion and the conchal wall stabilizer are moulded in one piece of a flexible material, such as rubber material.

According to an embodiment, the main body has a second side that faces away from the user's head when inserted and the cavity is provided in the second side and is adapted for holding an earphone speaker housing. Such an embodiment can be detached temporarily from the speaker housing for cleaning or replacement.

The sound opening may have a diameter of at least 3 mm, preferably at least 4 mm. This provides for a good acoustic coupling without filtering off the higher frequencies.

BRIEF DESCRIPTION OF THE DRAWINGS

The invention is explained in detail below with reference to the drawing illustrating preferred embodiments of the invention and in which.

The following reference signs are used in the figures and the following detailed description of the preferred embodiments:

1, 101 earphone device
2, 102 sound opening
3, 103 ear canal protrusion

Figure 1:
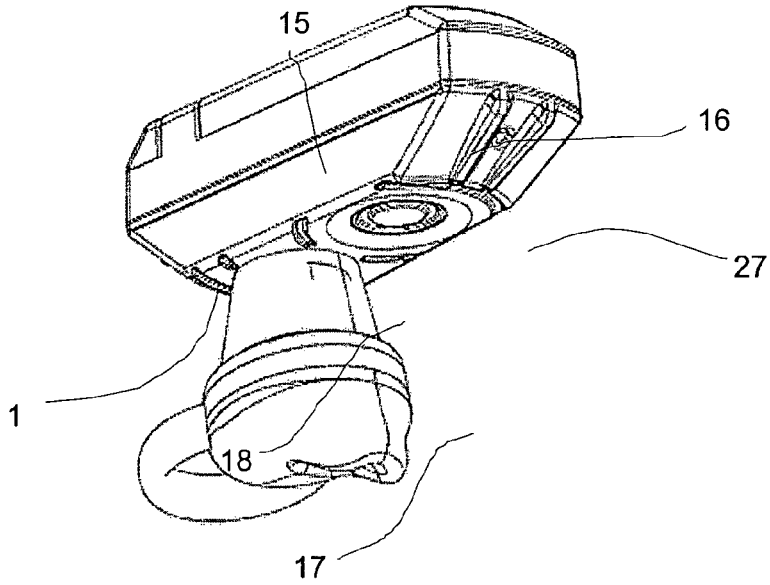
FIG. 1 is a perspective view of a headset with a first embodiment of an earphone device according to the invention, FIG. 2 the headset and earphone device of FIG. 1 seen from the side, FIGS. 3-6 the first embodiment of the earphone device seen from different angles, FIG. 7 a schematic side view of the ear of a user with the earphone device inserted therein, FIG. 8 the first embodiment of the earphone device in cross-sectional view and inserted in the ear of a user, and FIG. 9 a cross-sectional view through a second embodiment of an earphone device according to the invention.

4 conchal wall stabilizer
5 first side of main body
6 second side of main body
7 ear canal
8, 108 outer side of ear canal protrusion
9, 109 inner side of ear canal protrusion
10 wall of ear canal
11 first end of main body
12 second end of main body
13 cavity to receive a speaker housing
14 main body
15 earphone speaker housing
16 headset
17 microphone opening
18 button
19 rim of cavity
20 funnel-shaped cavity
21 crux of helix
22 tragus
23 antitragus
24 conchal wall
25 antihelix
26 helix
27 headset housing
28 ear
29 upper concha
30 lower concha
31 intertragic notch
X axis of sound opening
Y plane of the main body Modes for Carrying Out the Invention FIG. 1 is a perspective view of a wireless (e.g. Bluetooth) headset 16 to be used for telecommunication. The headset comprises a headset housing 27 that contains a battery, a printed circuit board with transmitter/receiver electronics etc. On or more control buttons 18 are arranged on the outside of the housing 27 and a microphone opening 17 is arranged at one end of the housing. At the opposite end, a speaker housing 15 protrudes from the side of the housing 17. An earphone device 1 according to the invention is detachably mounted on the free end of speaker housing 15.

Figure 2:
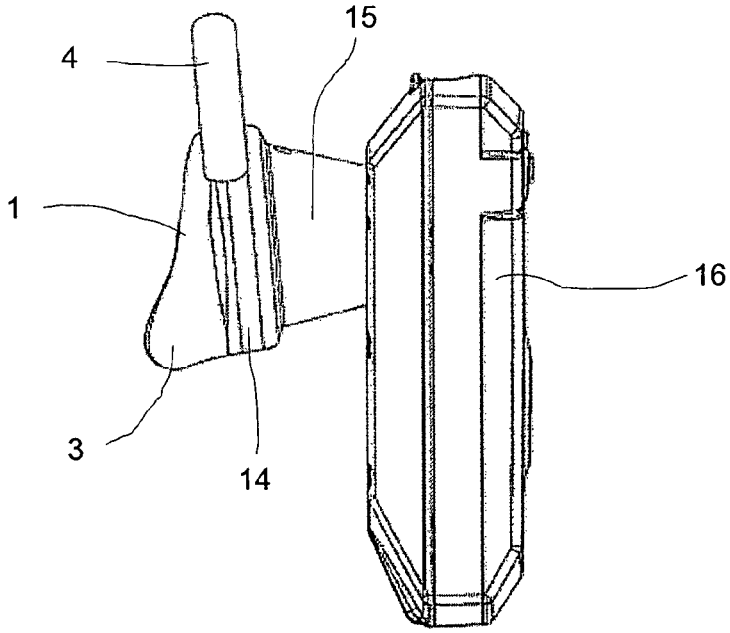

FIG. 2 discloses the headset 16 and earphone device 1 from the side. The earphone device 1 is designed to be fastened in the outer ear of a user in a comfortable way and lead sound from speaker openings (not visible) in the free end of the speaker housing 15 to the ear canal. The earphone device 1 comprises a main body 14, an ear canal protrusion 3 and a conchal wall stabilizer 4.

Figure 3:
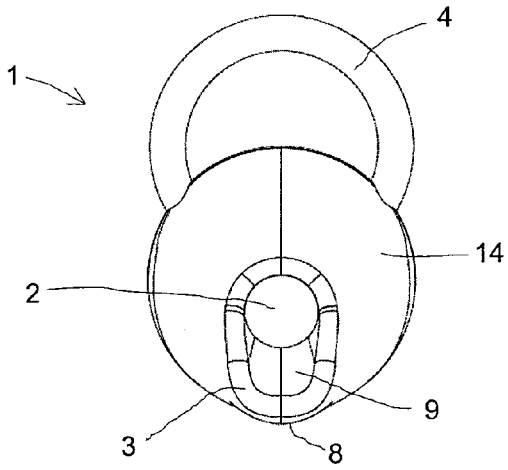
Figure 4:
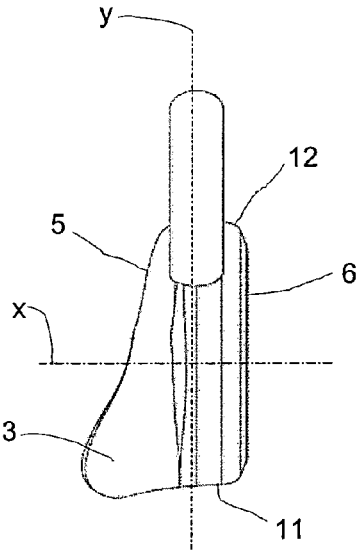
Figure 5:
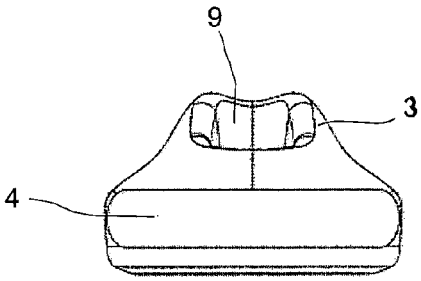
Figure 6:
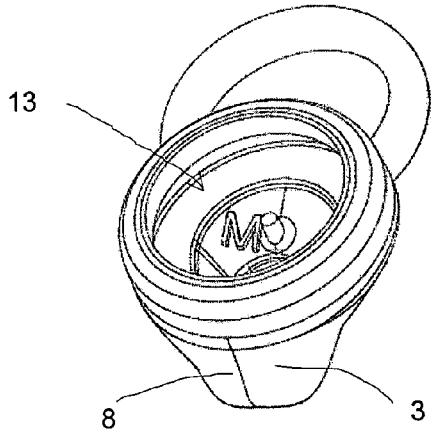

FIGS. 3-6 disclose the earphone device 1 detached from the headset and from different angles. FIG. 3 is a front view, FIG. 4 is a side view, FIG. 5 is a top view, and FIG. 6 is a perspective view from behind. The main body 14 has a first side (front) 5, a second side (back) 6, a first end (lower end) 11 and a second end (upper end) 12. The second side 6 is plane and parallel with the plane Y of the main body 14. The ear canal protrusion 3 protrudes from the first side 5 at the first end 11 of the main body 14 and in a direction essentially perpendicular to the plane Y of the main body 14. The conchal wall stabilizer 4 is loop-shaped and extends from the second end 12 and in the plane Y of the main body 14. A sound opening 2 in the first side 5 of the main body 15 is located just above the ear canal protrusion 3. The sound opening 2 has an axis X that is perpendicular to the plane Y of the main body 14. The ear canal protrusion 3 has an outer side 8 that is convex seen in cross section perpendicular to the axis X of the sound opening and parallel with the plane Y of the main body 14. The inner side 9 of the ear canal protrusion 3 that faces the sound opening 2 is concave when seen in the same cross section. FIG. 6 discloses a cavity 13 to receive the free end of the speaker housing 15. The earphone device 1 is moulded in one piece of flexible material, such as rubber.

Figure 7:
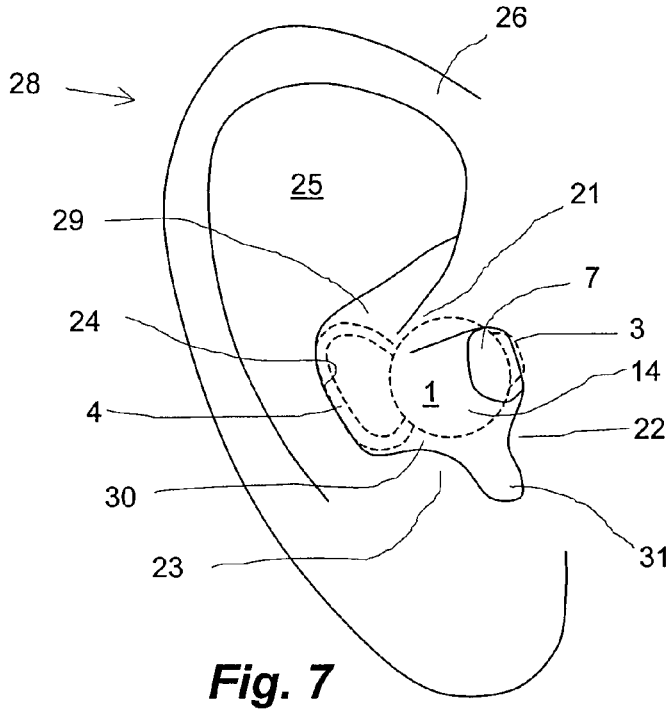

For illustration purposes and to aid in the understanding of the placement of the earphone device of the present invention, a typical human ear is illustrated in FIG. 7. The outer ear or pinna is an irregularly concave cartilaginous member comprised of a number of eminences and depressions, which give each ear a distinct shape and form. The helix 26 is the curved outer rim of the ear. Below the helix 26 is the antihelix 25. The antihelix 25 is a curved prominence, which describes a curve around the concha, a deep cavity containing the entry to the ear canal 7. The concha is divided into two parts, the upper concha 29 and the lower concha 30, by the crux of the helix 21, which curves around the outside of the ear, and extends inwards at about the vertical midpoint of the ear. The upper concha 29 lies above the crux of the helix 21 and below the antihelix 25. The lower concha 30 lies below the crux of the helix 21 and surrounds the entry to the ear canal 7. A conchal wall 24 separates the concha from the antihelix 25. In front of the lower concha 30 and projecting backwards from the front of the ear is the tragus 22, a small semicircular prominence. Opposite the tragus 22 and separated from it by the deep curvature of the intertragic notch 31 is the antitragus 23. The intertragic notch 31 is formed between the tragus 22 and the antitragus 23.

Furthermore, FIG. 7 discloses schematically with dashed lines how the earphone device 1 is positioned in the ear 28 during use. The ear canal protrusion 3 is inserted into the ear canal 7 where it abuts the forward wall 10 (see FIG. 8) of the ear canal 7. The conchal wall stabilizer 4 abuts the conchal wall 24. As seen, the loop shaped conchal wall stabilizer 4 is elastically deformed to fit the curvature of the conchal wall 24 by compression. In this way, the earphone device exerts a compression force against the conchal wall 24 and the forward wall 10 of the ear canal 7. This secures the earphone device 1 in the ear and thereby the headset outside ear even when the user moves or accelerates his head in different directions. Thus, no external support such as an ear hook or a headband is necessary.

Figure 8:
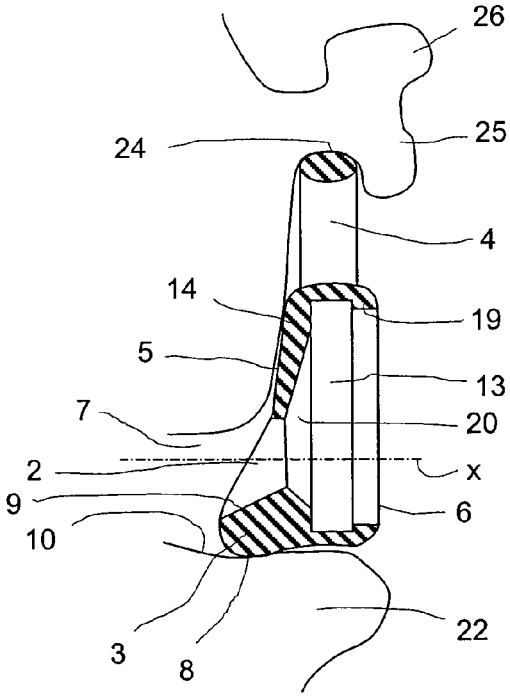

FIG. 8 discloses the earphone device 1 in cross section, while it is mounted in the ear of a user. The headset is removed for clarity reasons. It is clear, that the outer side 8 of the ear canal protrusion 3 abuts the forward wall 8 of the ear canal 7 and that the conchal wall stabilizer 4 abuts the conchal wall 24. The cavity 13 for receiving the speaker housing 15 of the headset 16 is open to the second side 6 of the main body 14. The cavity 13 is circular and the opening in second side 6 is encircled by a rim 19. When the earphone device 1 is mounted on the speaker housing 15 the rim 19 grips behind a corresponding rim on the outside of the free end of the speaker housing 15. In this way, the earphone device 1 and the headset 16 remains coupled. A certain force must be exceeded to pull the earphone device 1 of the speaker housing 15. Sound from the openings in the end face of the speaker housing 15 is led through a funnel-shaped cavity 20 to the sound opening 2, which is positioned in front of the ear canal 7. It can be seen in FIG. 8 and FIGS. 3 and 5 that the main part of the ear canal protrusion 3 is positioned below the sound opening 2. However, as the ear canal protrusion 3 has a large upper area sloping against the first side 5 of the main body 14 the sound opening 2 and the protrusion 3 provides a chute- or through-like shape. This is opposite to the prior art that discloses a sound opening arranged in the tip of the ear canal protrusion. The ear canal protrusion 3 has in FIG. 3 a convex outer side (under side) and a concave inner side (upper side) when seen in the plane of the paper. The axis X of the sound opening 2 is perpendicular to this plane. As shown in FIG. 8, the ear canal protrusion 3 only abuts the forward facing part of the ear canal wall 8. Thus, the ear canal protrusion 3 does not seal the ear canal 7, and discomfort due to occlusion is avoided. The sound does not have to travel through a long narrow bore or tube between the loudspeaker housing 15 and the ear canal 7 and high-frequency filtering is hereby avoided. With other words, an open a clear sound is obtained due to the relatively large sound opening, the diameter of which is preferably at least 3 or 4 mm at the transition area between the sound opening 2 and the funnel-shaped cavity 20. This is the narrowest area of the sound opening 2.

The maximum depth of the earphone device measured in the direction of the axis X of the sound opening 2 is the distance between the tip of the ear canal protrusion 3 and the second side (back side) 6 of the main body and is approximately 10 mm. The maximum depth of the sound opening the distance between the tip of the ear canal protrusion 3 and the funnel-shaped cavity 20 and is approximately 5 mm. The minimum depth of the sound opening 2 is measured at the point closest to the intra-concha stabilizer 4 and is approx. 1 mm. The depth of the funnel-shaped cavity is approximately 1 mm. The depth of the speaker house receiving cavity 13 is approximately 3 mm and the depth of the rim 19 is approximately 1 mm. The outer diameter of the circular main body 14 is approximately 16 mm. The maximum dimension of the earphone device 1 measured perpendicular to the axis X of the sound opening 2 is approximately 25 mm. In order to provide earphone devices 1 to ears of different sizes the size of the conchal wall stabilizer 4 and the ear canal protrusion 3 can be varied. Thus, a headset can be provided with three different earphone devices with identical main bodies 14 but different sized ear canal protrusions 3 and conchal wall stabilizers 4.

Figure 9:
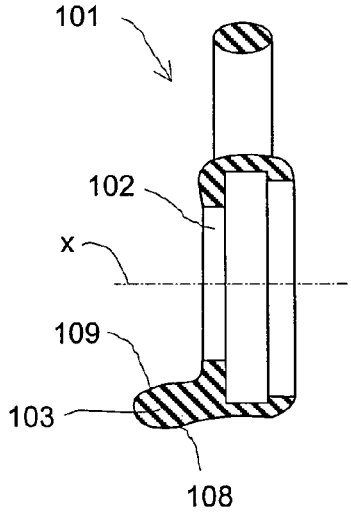

FIG. 9 discloses a second embodiment of the earphone device 101 according to the invention. The second embodiment differs from the first embodiment by the shape of the ear canal protrusion 103 and the size of the sound opening 102. The ear canal protrusion 103 is thinner than the ear canal protrusion of the first embodiment. This leaves space for a sound opening 102 with a much larger diameter.

The invention is not limited to the disclosed embodiments. The disclosed embodiments are devices adapted to be mounted on the speaker housing of a headset. However, the earphone device according to the invention could also be a headset or a hearing aid comprising speaker, electronics etc.

The invention claimed is:

1. An earphone device comprising a main body to be inserted in to the outer ear canal of a user, the ear canal having an upper and lower portion as defined when worn in an upright user, the main body of the device having a first side that faces the user's head when inserted, a cavity and a sound opening connecting the first side with the cavity, the main body further comprises an ear canal protrusion, having an upper and lower edge, to be inserted into the entrance of the ear canal, wherein the cross section of the ear canal protrusion is smaller than the cross section of the ear canal and that the ear canal protrusion is having a first side adapted to lie against the ear canal wall and a second side lying opposite the first side and beside the sound opening; said sound opening being offset in said protrusion to be immediately adjacent said lower edge and wherein the second side of the ear canal protrusion has a peripheral edge which is symmetric about a vertical axis bisecting the second side into two portions, and wherein each portion has a convex profile extending into the ear canal, said side portions being joined together at the lower edge by a concave central portion which is less intrusive of the ear canal than said convex portions, so that high frequency sound absorption by the main body is minimized.

2. An earphone device according to claim 1, wherein the second side of the ear canal protrusion is bordering the periphery of the sound opening.

3. An earphone device according to claim 1, wherein the ear canal protrusion extends along a part of the sound openings periphery.

4. An earphone device according to claim 1, wherein the first side of the ear canal protrusion is convex seen in cross-section perpendicular to axis (X) of the sound opening.

5. An earphone device according to claim 4, wherein the second side of the ear canal protrusion is concave seen in cross-section perpendicular to the axis (X) of the sound opening.

6. An earphone device according to claim 1, wherein the earphone device comprises a conchal wall stabilizer extending from the main body and adapted to engage the conchal wall of the ear wherein the conchal wall stabilizer extends from the main body and adapted to engage the conchal wall of the ear, said conchal wall being a resilient tubular structure attached having two ends both being attached to the main body at spaced apart points thereon and thereby forming a deflectable arch which may adapt to the variable shapes and sizes of a users ear.

7. An earphone device according to claim 6, wherein the conchal wall stabilizer extends from the main body in a direction essentially opposite the first side of the ear canal protrusion, such that the earphone device can be firmly fixed between the ear canal wail and the conchal wall.

8. An earphone device according to claim 7, wherein the conchal wall stabilizer is loop shaped defining an opening between the stabilizer and main body so that deflection of the stabilizer will be free to fill the opening.

9. An earphone device according to claim 6, wherein the main body, the ear canal protrusion and the conchal wall stabilizer are moulded in one piece of a flexible material.

10. An earphone device according to claim 1, wherein the main body has a second side that faces away from the user's head when inserted and that the cavity is provided in the second side and is adapted for holding an earphone speaker housing.

11. An earphone device according to claim 1, wherein the sound opening has a diameter of at least 3 mm, preferably at least 4 mm.

12. An earphone device comprising a main body to be inserted in to the outer ear canal of a user, the ear canal having an upper are lower portion in an upright user, the main body of the device having a first side that faces the user's head when inserted, a cavity and a sound opening connecting the first side with the cavity, the main body further comprises an ear canal protrusion, having an upper and lower edge, to be inserted into the entrance of the ear canal, wherein the cross section of the ear canal protrusion is smaller than the cross section of the ear canal and that the ear canal protrusion is having a first side adapted to lie against the ear canal wall and a second side lying opposite the first side and beside the sound opening; and wherein the earphone device includes a conchal wall stabilizer extending from the main body and adapted to engage the conchal wall of the ear, said conchal wall stabilizer being a resilient tubular structure attached having two ends both being attached to the main body a spaced apart points thereon and thereby forming a deflectable arch which may adapt to the variable shapes and sizes of a users ear.

13. An earphone device according to claim 12, wherein the main body, the ear canal protrusion and the conchal wall stabilizer are moulded in one piece of a flexible material.

14. An earphone device according to claim 12, wherein the conchal wall stabilizer is a resilient tubular structure which is compressible and deflectable.

* * * * *